US005815172A

United States Patent [19]

Moh

[11] Patent Number: 5,815,172

[45] Date of Patent: Sep. 29, 1998

[54] METHOD AND STRUCTURE FOR CONTROLLING THE ENERGIZING OF AN INK JET PRINTHEAD IN A VALUE DISPENSING DEVICE SUCH AS A POSTAGE METER

[75] Inventor: Sungwon R. Moh, Wilton, Conn.

[73] Assignee: Pitney Bowes, Inc., Stamford, Conn.

[21] Appl. No.: 707,984

[22] Filed: Aug. 23, 1996

[51] Int. Cl.[6] ..... B41J 29/38

[52] U.S. Cl. ..... 347/14; 347/5; 347/37; 400/279

[58] Field of Search ..... 400/279, 283; 347/5, 10, 11, 14, 37

[56] References Cited

U.S. PATENT DOCUMENTS

| | | | |
|---|---|---|---|
| 4,126,867 | 11/1978 | Stevenson, Jr. . | |
| 4,203,678 | 5/1980 | Nordstrom et al. . | |
| 4,344,079 | 8/1982 | MChambers et al. . | |
| 4,346,393 | 8/1982 | Wallace et al. . | |
| 4,734,706 | 3/1988 | Le et al. | 346/1.1 |
| 4,743,924 | 5/1988 | Scardovi . | |
| 4,840,696 | 6/1989 | Krasuki et al. . | |
| 5,049,898 | 9/1991 | Arthur et al. . | |
| 5,155,499 | 10/1992 | Goetz et al. . | |
| 5,239,312 | 8/1993 | Merns et al. . | |
| 5,245,359 | 9/1993 | Ito et al. . | |
| 5,317,758 | 5/1994 | Tatuzawa | 400/120.05 |
| 5,339,098 | 8/1994 | Nagatomo et al. . | |
| 5,442,774 | 8/1995 | Pickup et al. . | |
| 5,452,095 | 9/1995 | Ono et al. . | |
| 5,455,606 | 10/1995 | Keeling et al. . | |
| 5,465,109 | 11/1995 | Bowers | 347/74 |
| 5,471,925 | 12/1995 | Heinrich et al. . | |
| 5,481,288 | 1/1996 | Keeling et al. . | |
| 5,485,178 | 1/1996 | Tateyama . | |
| 5,493,300 | 2/1996 | Eiler et al. . | |

FOREIGN PATENT DOCUMENTS

| | | | |
|---|---|---|---|
| 29515669U1 | 1/1996 | Germany | B41J 2/04 |
| 1475937 | 8/1974 | United Kingdom . | |
| 1587811 | 1/1978 | United Kingdom . | |
| 2034947 | 11/1979 | United Kingdom . | |

*Primary Examiner*—John S. Hilten

*Attorney, Agent, or Firm*—Steven J. Shapiro; Melvin J. Scolnick

[57] ABSTRACT

A method for controlling energizing of an ink jet printhead includes the steps of generating encoder pulses to a motor to activate the motor to move the printhead at a desired speed over a recording medium; generating and sending fire pulses at a fire pulse frequency from an ASIC to an ink jet printhead driver chip to selectively energize ink jet printhead nozzles to eject drops of ink onto the recording medium based on a predetermine relationship between an expected encoder pulse frequency and the fire pulse frequency; compensating for variations in the speed of the ink jet printhead movement caused by variations in the encoder pulse frequency by using the ASIC for continuously comparing the encoder pulse frequency to the fire pulse frequency and for adjusting the fire pulse frequency based upon the variations to the encoder pulse frequency to maintain the predetermined relationship thereby synchronizing the ink jet printhead movement with the energizing of the printhead nozzles.

11 Claims, 2 Drawing Sheets

METHOD AND STRUCTURE FOR CONTROLLING THE ENERGIZING OF AN INK JET PRINTHEAD IN A VALUE DISPENSING DEVICE SUCH AS A POSTAGE METER

BACKGROUND

This invention relates to control circuitry for an ink jet printhead and more particularly to control circuitry, for an ink jet printhead used in a value dispensing device such as a postage meter, which accurately controls nozzle energizing, reduces peak power requirements, and finely controls nozzle drop volume.

With the introduction of digital printing, such as ink jet printing, a new generation of value dispensing devices, such as postage meters, is being created. These new value dispensing devices utilize ink jet printing to print an image which serves as an indication of value and provide great printing flexibility since any desired image change can easily be accommodated via software changes. However, since the ink jet printhead is typically moving relative to the recording medium upon which the indication of value is to be printed, the precise control of the energizing of the printhead nozzles in synchronization with movement of the printhead is critical in producing a quality image. Since speed variations associated with the motor for moving the printhead often occur, they can significantly impact image quality if not accounted for. Accordingly, what is needed is a simple and precise structure for compensating for such speed variations.

In addition to the above, if a piezoelectric ink jet printhead is utilized, there is a residual oscillation of the excited piezo-material upon removal of the firing pulse applied thereto. This uncontrolled oscillation makes it very difficult to obtain a consistent ink drop size which is ejected from the ink jet nozzles. Accordingly, this oscillation must be compensated for or eliminated to ensure consistent ink drop size and a corresponding homogeneous print quality associated therewith.

Furthermore, if a low cost value dispensing device is desired, one of the cost drivers in such a device is the power supply. If the peak power requirements of the power supply are reduced, the cost of the power supply is also reduced. Since the peak power requirement typically occurs during firing of the printhead nozzles, it is desirable to minimize such requirement as compared to prior art devices.

Finally, in many printing devices, the printhead control circuitry is specifically designed to operate with a specified printhead and a specified ink. Accordingly, if a substitute printhead or a different ink are to be used, the control circuitry has to be redesigned. What is needed is a programmable control circuit which can be easily changed to accommodate different printheads and different inks.

SUMMARY OF THE INVENTION

It is an object of the invention to provide an improved method and apparatus for controlling energizing of a printhead. These objects are met by a method for controlling energizing of an ink jet printhead includes the steps of generating encoder pulses to a motor to activate the motor to move the printhead at a desired speed over a recording medium; generating and sending fire pulses at a fire pulse frequency from an ASIC to an ink jet printhead driver chip to selectively energize ink jet printhead nozzles to eject drops of ink onto the recording medium based on a predetermine relationship between an expected encoder pulse frequency and the fire pulse frequency; compensating for variations in the speed of the ink jet printhead movement caused by variations in the encoder pulse frequency by using the ASIC for continuously comparing the encoder pulse frequency to the fire pulse frequency and for adjusting the fire pulse frequency based upon the variations to the encoder pulse frequency to maintain the predetermined relationship thereby synchronizing the ink jet printhead movement with the energizing of the printhead nozzles. An apparatus incorporates the inventive method

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
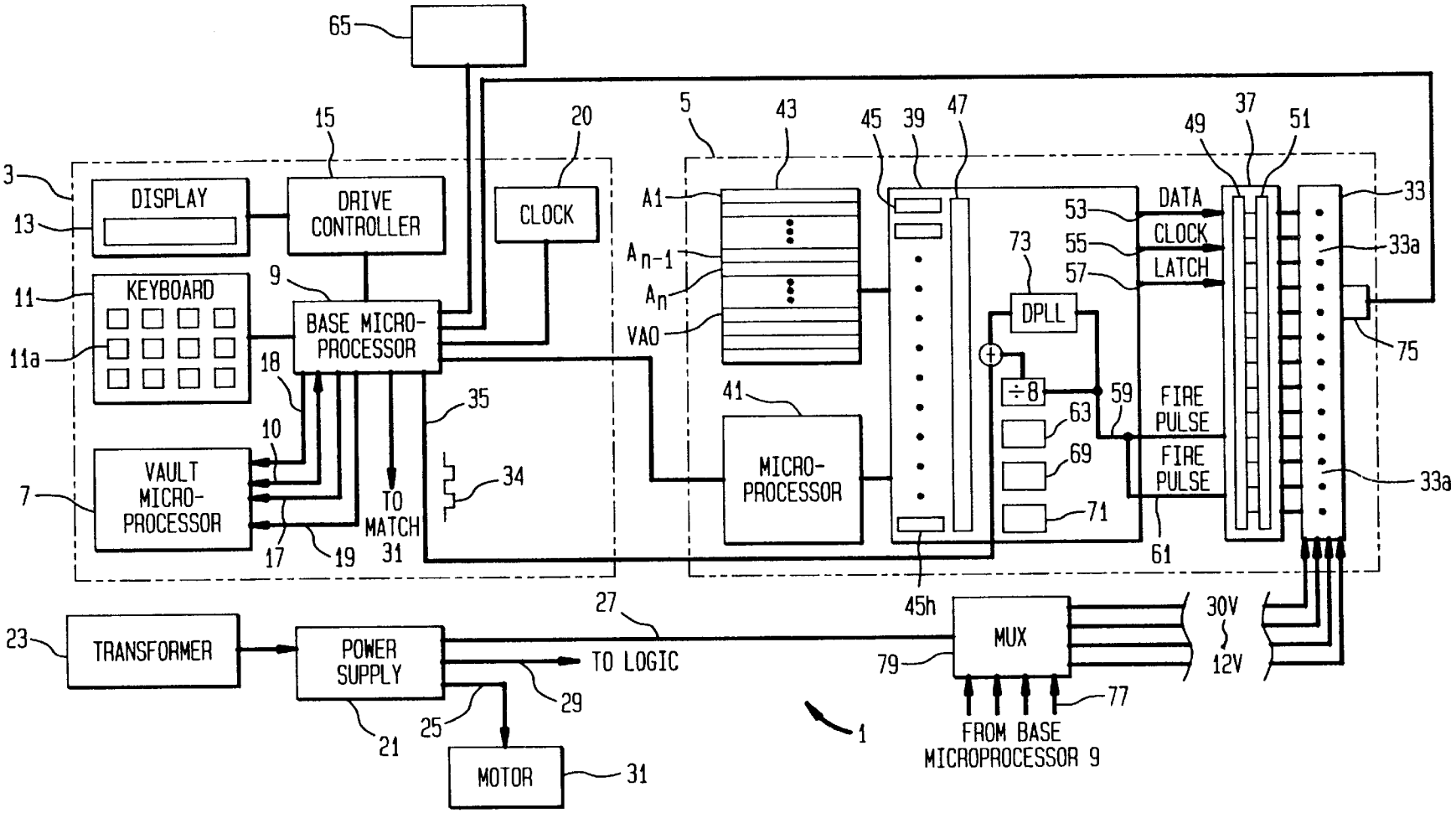
FIG. 1 is an electrical block diagram of the inventive control circuit incorporated in a postage meter.

FIG. 1 shows an electrical block diagram of a postage meter 1 implementing the invention. Postage meter 1 includes two primary modules, a base module 3 and a printhead module 5. Base module 3 includes a vault microprocessor 7 and a transaction microprocessor 9. Vault microprocessor 7 has software and associated memory to perform conventional accounting functions of postage meter 1. That is, vault microprocessor 7 has the capability to have downloaded therein in a conventional manner a predetermined amount of postage funds. During each postage transaction, vault microprocessor 7 checks to see if sufficient funds are available. If sufficient funds are available, vault microprocessor 7 debits the amount from a descending register, adds the amount to an ascending register, and sends the postage amount to the printhead module 5 via the transaction microprocessor 9. Transaction microprocessor 9 also sends the date data to the printhead module 5 so that a complete indicia image can be printed.

Vault microprocessor 7 thus manages the postage funds with the ascending register representing the lifetime amount of postage funds spent, the descending register representing the amount of funds currently available, and a control sum register showing the running total amount of funds which have been credited to the vault microprocessor 7. Additional features of vault microprocessor 7 which can be included are a piece counter register, encryption algorithms for encoding the information sent to the printhead module 5, and software for requiring a user to input a personal identification number which must be verified by the vault microprocessor 7 prior to its authorizing a postage transaction.

Transaction microprocessor 9 acts as a traffic cop in coordinating and assisting in the transfer of information along data line 10 between the vault microprocessor 7 and the printhead module 5, as well as coordinating various support functions necessary to complete the metering function. Transaction microprocessor 9 interacts with keyboard 11 to transfer user information input through keyboard keys 1 la (such as PIN number, postage amount) to the vault microprocessor 7. Additionally, transaction microprocessor 9 sends data to a liquid crystal display 13 via a driver/controller 15 for the purpose of displaying user inputs or for prompting the user for additional inputs. Moreover, base microprocessor 9 provides power, clock, and a reset signal to vault microprocessor 7 via respective lines 17, 18, and 19. A clock 20 provides date and time information to transaction microprocessor 9. Alternatively, clock 20 can be eliminated and the clock function can be accomplished by the base microprocessor 9.

Postage meter 1 also includes a conventional power supply 21 which conditions raw A.C. voltages from a wall mounted transformer 23 to provide the required regulated and unregulated D.C. voltages for the postage meter 1. Voltages are output via lines 25, 27, and 29 to respectively a printhead motor 31, printhead 33 (which in the preferred embodiment is a piezoelectric printhead) and all logic circuits. Motor 31 is used to control the movement of the printhead relative to the mailpiece upon which an indicia is to be printed. Base microprocessor 9 controls the supply of power to motor 31 to ensure the proper starting and stopping of printhead 33 movement after vault microprocessor 7 authorizes a postage transaction.

Base module 3 also sends an encoder signal 34, via line 35, that correlates to the number of pulses sent by base microprocessor 3 to stepper printhead motor 31 so that the exact position of printhead 33 can be determined based on encoder signal 34. Encoder signal 34 is sent to printhead module 5 to synchronize the energizing of individual printhead elements 33*a* in printhead 33 with the positioning of printhead 33 by motor 31, as will be discussed in more detail below.

Printhead module 5 includes printhead 33, a printhead driver 37, an Application Specific Integrated Circuit (ASIC) 39, a microprocessor 41 and a non-volatile memory 43. NVM 43 has stored therein image data of the fixed indicia and image data for each individual font that can be required as part of the variable data of a postage indicia to be printed by postage meter 1. Microprocessor 41 receives a print command, postage amount, and date via the transaction microprocessor 9. The postage amount and date are sent from microprocessor 41 to the ASIC 39 which then accesses non-volatile memory 43 (having addresses A1-VAO . . . ) to obtain image data therefrom which is then downloaded by ASIC 39 to the printhead driver 37 in order to energize individual printhead elements 33*a* to produce a single column dot pattern of the indicia. The individual column-by-column generation of the indicia is synchronized with movement of printhead 33 until the full indicia is produced. The specific details of the column-by-column generation of the postage indicia including use of the variable address registers 45–45*h* and buffer 47 of ASIC 39 is set forth in U.S. Pat. No. 5,651,103.

The control circuitry for printhead 33 will now be described in more detail with reference to FIGS. 1 and 2. The printhead control circuitry primarily includes ASIC 39, driver chip 37 and printhead 33. Driver chip 37 has a shift register 49 and another register 51 contained therein. ASIC 39 sends image data from buffer 47, via data line 53, in a serial manner to shift register 49 together with a clock signal via clock line 55. In the preferred embodiment and as discussed in more detail in the aforementioned U.S. patent application Ser. No. 08/554,179, buffer 47 contains a single column of image data which is downloaded into shift register 49. When ASIC 39 sends a latch signal, via line 57, the single column of image data contained in shift register 49 is latched into register 51 so that the next column of image data can be sent from ASIC 39 and downloaded into shift register 49. Subsequently, upon receipt of first and second fire pulse signals 59, 61, the even numbered and odd numbered nozzles 33*a* are respectively energized to deposit ink drops on a recording medium surface. That is, when fire pulse 59 is in an active state,. the odd numbered nozzles (1, 3, 5, . . . ) are fired or not fired depending upon the corresponding bit value in register 51 associated therewith and when fire pulse 61 is in its active state the even numbered nozzles (2, 4, 6, . . . ) are fired or not fired depending upon the bit value contained in the corresponding address of register 51.

Figure 2:
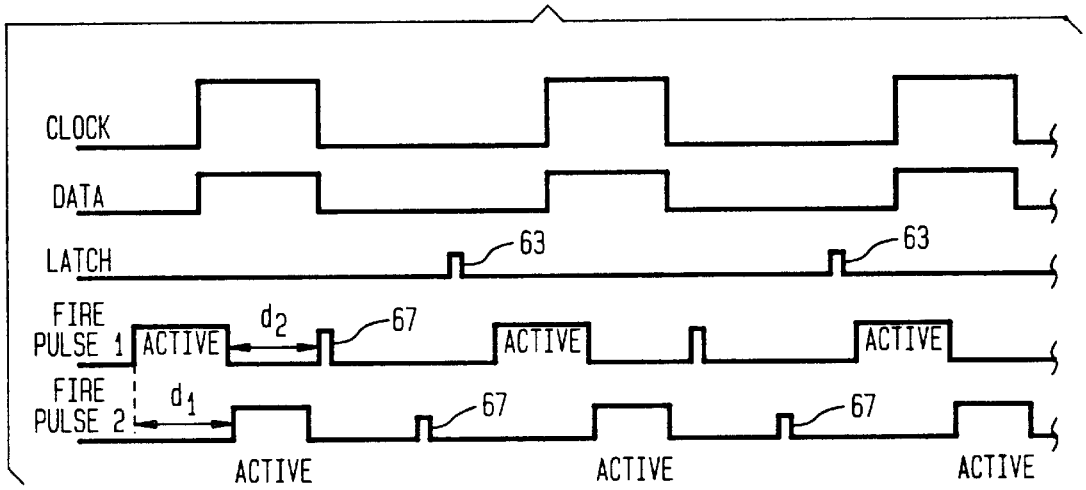
FIG. 2 is a timing diagram for data, clock signals, latch signals, and firing signals utilized in the inventive circuit.

As shown in FIG. 2, the latch signal is not sent until the previous first and second firing pulses are completed, otherwise the previous first and second firing pulses would be corrupted with the new data being sent to the register 51. Moreover, it is also to be noted that the second fire pulse 61 is delayed by a delay time period d1 relative to first fire pulse 59 in order to minimize the power supply requirements for the printhead 33. That is, if all of the nozzles 33*a* were fired at the same time, the peak power requirement for power supply 21 is much greater than the peak power requirement associated with the inventive first and second fire pulse signals 59, 61 whereby the odd and even nozzles are fired at separate times. By reducing the peak power supply requirement of power supply 21, the design of power supply 21 is simplified and the cost associated therewith is significantly reduced. ASIC 39 has a programmable register 63 therein which contains the desired delay time d1. In one embodiment the value of register 63 can easily be changed, based on an input by the operator or maintenance person via keyboard 11 and associated software contained in microprocessor 41. Moreover, the updating of register 63 could also be accomplished via a remote data center 65, which communicates in a known manner with transaction microprocessor 9.

In addition to the above, both first and second fire pulses 59, 61 include a cancel pulse 67 which occurs after each individual active portion of first and second fire pulses 59,61. The pulse width of cancel pulse 67 and the time delay d2 (time between completion of active portion until cancel pulse begins) are respectively stored in registers 69 and 71. The values in registers 69, 71 can be changed in a manner similar to that discussed above in connection with register 63.

The implementation of cancel pulse 67 solves a problem inherent with the piezoelectric printhead 33. As is well known in the art, a piezoelectric printhead operates on the principle that when a voltage is applied and removed from a piezo-material, the piezo-material will respectively first expand and then contract to its original form. This oscillating movement of the piezo-material is utilized in a printhead to force a volume of ink out of a printhead nozzle. That is, there is a piezo-material typically positioned within each liquid supply chamber associated with each individual nozzle of the printhead 33. By selectively applying and removing a voltage to each individual piezo-material, the ink in the liquid supply chamber is forced out of the corresponding nozzle. Therefore, if the specific response characteristics of the piezo-material are known, the drop volume ejected from each nozzle can be precisely determined by applying a particular voltage for a particular length of time (fire pulse) to the piezo-material. However, even after the fire pulse is removed, there will still be a residual oscillation of the piezo-material that naturally occurs. This residual oscillation continues to act to force ink out of the nozzles preventing the precise control of drop volume. Since the consistency of drop volume is highly critical for producing a uniform, high quality image, it is desirable to minimize the effect of the residual oscillation. The cancel pulse accomplishes this goal by negating the residual oscillation. In essence, the cancel pulse dampens out the residual oscillation. The specific characteristics of the cancel pulse width and the delay time d2 will be driven by the characteristics of the piezo-material used and the voltage and fire pulse applied to the piezo-material. However, it is well within the skill of one possessing ordinary skill in the art to derive such cancel pulse parameters and therefore a detailed description is not considered necessary for an understanding of the claimed invention.

In addition to the above, another important factor which is very important if a quality image is to be produced is the ability to control the synchronizing of the printing of data with the movement of the printhead over the recording medium. In prior art structures, the fire pulse was produced by the ASIC to coincide with the anticipated printhead motor movement. A base microprocessor which controlled the printhead motor would send out an interrupt signal to the ASIC to identify when the firing pulse should have ended so that the latch signal could be sent. However, there was nothing in this system that would compensate for printhead motor speed variations such that the firing pulse and printhead movement could become out of synchronization thereby degrading the printed image. To correct the problem of the prior art, the inventive ASIC 39 incorporates a digital phase-locked loop circuit 73 which receives encoder signal 34 from base microprocessor 9. As previously stated, the encoder signal 34 is indicative of the pulses applied by the CPU to the stepper motor. However, to reduce the workload of base microprocessor 9, each encoder pulse which is sent corresponds to eight fire pulses. Thus, the DPLL circuit compares the encoder signal input pulses to the actual fire pulse produced by the ASIC 39 and if they are different, the inactive portion of the fire pulse is shortened or lengthened depending upon whether the fire pulse is running behind the encoder signal or in front of it. In this manner, the timing of the fire pulses are constantly being adjusted to compensate for motor speed variations resulting in higher quality printing. Additionally, with the finer control of the fire pulses, the inactive period between fire pulses can be reduced resulting in quicker printing. The changes in the frequency in the encoder pulses which results in motor speed variations is caused by the fact that base microprocessor 9 is performing many functions within the postage meter 1. Accordingly,. as base microprocessor 9 coordinates the multiple tasks it is responsible for, it prioritizes those tasks which can result in a delay in pulsing the motor 31.

Yet another factor which can effect print quality is the ambient temperature that the printhead operates in. The viscosity of the ink will change as a function of temperature. If the viscosity changes, the ability of the piezo-material to eject a desired drop volume will be effected. Accordingly, the ambient temperature is sensed via a thermister 75 and fed to transaction microprocessor 9. Transaction microprocessor 9 is programmed to change the control signals 77 to MUX 79 to vary the voltage output from MUX 79 to printhead 33 in accordance with the sensed temperature and the viscosity changes to the ink in order to maintain a consistent ink drop size. Alternatively, the sensed temperature could be fed to ASIC 39, and the active portion (pulse width) of the fire pulses changed to compensate for ink viscosity changes driven by temperature changes.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed:

1. A method for controlling energizing of an ink jet printhead comprising the steps of:

generating motor pulses to a motor to activate the motor to move the printhead at a desired speed over a recording medium;

providing a motor pulse signal indicative of an actual motor pulse frequency;

generating and sending a first fire pulse signal including a fire pulse which is fired at a fire pulse frequency from an ASIC to an ink jet printhead driver chip to selectively energize ink jet printhead nozzles to eject drops of ink onto the recording medium based on a predetermined relationship between an expected motor pulse frequency and the fire pulse frequency;

compensating for variations in the speed of the ink jet printhead movement caused by variations in the actual motor pulse frequency relative to the expected motor pulse frequency by using the ASIC for continuously comparing the motor pulse signal indicative of the actual motor pulse frequency to the fire pulse frequency to determine if the predetermined relationship exists and if the predetermined relationship does not exist adjusting the fire pulse frequency based upon the variations to the actual motor pulse frequency to maintain the predetermined relationship thereby synchronizing the ink jet printhead movement with the energizing of the printhead nozzles.

2. A method as recited in claim 1, wherein the printhead nozzles are comprised of first and second groups of nozzles, and further comprising generating and sending a second fire pulse signal including the fire pulse which is fired at the fire pulse frequency from the ASIC to the ink jet printhead driver chip to selectively energize the second group of nozzles and wherein the first fire pulse signal selectively energizes the first group of nozzles, and generating and sending the first and second fire pulse signals out of phase with each other to reduce a peak power requirement associated with the energizing of the first and second groups of nozzles.

3. A method as recited in claim 2, wherein the first and second fire pulse signals are out of phase with each other so that ejection of drops of ink from the first and second groups of nozzles do not occur concurrently.

4. A method as recited in claim 1, wherein each of the printhead nozzles has a corresponding piezo-material actuator, and further comprising the steps of applying a voltage to selected ones of the actuators causing the selected ones of the actuators to oscillate and eject drops of ink from their corresponding nozzles, removing the voltage from the selected ones of the actuators, and then applying a cancel pulse to dampen residual oscillation of the selected ones of the actuators thereby controlling drop volume.

5. A method as recited in claim 4, further comprising providing the ASIC with first and second programmable circuitry, and storing a changeable width of the fire pulse in the first programmable circuitry and storing a changeable width of the cancel pulse in the second programmable circuitry.

6. A method as recited in claim 5, further comprising providing the ASIC with third programmable circuitry and storing a changeable cancel pulse time delay in the third programmable circuitry which changeable cancel pulse time delay corresponds to a time between the removing of the voltage from the selected ones of the actuators and an initial application of the cancel pulse.

7. A method as recited in claim 6, further comprising reprogramming one of the first, second and third programmable circuitry to respectively store a new width of the fire pulse, a new width of the cancel pulse and a new cancel pulse time delay.

8. A postage meter comprising:

a printhead for printing an indication of postage value on a recording medium;

a motor for moving the printhead;

microprocessor means for generating motor pulses to the motor to activate the motor to move the printhead at a desired speed over the recording medium, for performing additional functions within the postage meter, and for generating a motor pulse signal indicative of an actual motor pulse frequency;

means for generating and sending a first fire pulse signal including a fire pulse which is fired at a fire pulse frequency to an ink jet printhead driver chip to selectively energize ink jet printhead nozzles to eject drops of ink onto the recording medium based on a predetermined relationship between an expected motor pulse frequency and the fire pulse frequency;

means for compensating for variations in the speed of the ink jet printhead movement caused by variations in the actual motor pulse frequency relative to the expected motor Pulse frequency, the compensating means including means for receiving the motor pulse signal and continuously comparing the motor pulse signal indicative of the actual motor pulse frequency to the fire pulse frequency to determine if the predetermined relationship exists and if the predetermined relationship does not exist adjusting the fire pulse frequency based upon the variations to the actual motor pulse frequency to maintain the predetermined relationship thereby synchronizing the ink jet printhead movement with the energizing of the printhead nozzles; and means for accounting for the printed postage value.

9. A postage meter as recited in claim 8, wherein the comparing means includes a digital phased lock loop circuit.

10. A method as recited in claim 9, further comprising an ASIC which includes the generating and sending means and the compensating means, and wherein the ASIC includes a programmable element within which a width of the fire pulse is changeably stored.

11. A method for controlling energizing of an ink jet printhead comprising the steps of:

generating motor pulses from a microprocessor to a motor to activate the motor to move the printhead at a desired speed over a recording medium;

sending from the microprocessor a motor pulse signal indicative of an actual number of motor pulses generated by the microprocessor;

generating and sending a fire pulse signal including a fire pulse which is fired at a fire pulse frequency from an ASIC to an ink jet printhead driver chip to selectively energize ink jet printhead nozzles to eject drops of ink onto the recording medium based on a desired predetermined relationship between the motor pulses generated by the microprocessor and the fire pulses generated by the ASIC; and compensating for variations in the speed of the ink jet printhead movement caused by variations in an actual frequency at which the motor pulses are generated by the microprocessor relative to an expected motor pulse frequency by using the ASIC for continuously comparing the actual number of motor pulses generated by the microprocessor to the actual number of fire pulses generated by the ASIC to determined if the predetermined relationship exists and if the predetermined relationship does not exist adjusting the fire pulse frequency to maintain the predetermined relationship thereby synchronizing the ink jet printhead movement with the energizing of the printhead nozzles.

* * * * *